US008402619B2

(12) United States Patent
Arcand et al.

(10) Patent No.: US 8,402,619 B2
(45) Date of Patent: Mar. 26, 2013

(54) SYSTEM AND METHOD FOR REDUCING ENVIRONMENTAL CREMATORIAL RELEASE OF MERCURY FROM MERCURY-CONTAINING DENTAL AMALGAM

(75) Inventors: Benjamin Arcand, Minneapolis, MN (US); Bryan N. Rolfes, St. Paul, MN (US); Nikhil M. Murdeshwar, Maple Grove, MN (US); Joseph E. Hale, Maplewood, MN (US); Steven M. Johnson, La Crosse, WI (US); Luke A. Mitlyng, Litchfield, MN (US); Joseph Mullenbach, Adams, MN (US); Kristopher I. Kapphahn, Minneapolis, MN (US)

(73) Assignee: Minnesota Funeral Directors Association, Maple Grove, MN (US)

( * ) Notice: Subject to any disclaimer, the term of this patent is extended or adjusted under 35 U.S.C. 154(b) by 570 days.

(21) Appl. No.: 12/625,176

(22) Filed: Nov. 24, 2009

(65) Prior Publication Data

US 2010/0132173 A1 Jun. 3, 2010

Related U.S. Application Data

(60) Provisional application No. 61/117,277, filed on Nov. 24, 2008, provisional application No. 61/174,593, filed on May 1, 2009.

(51) Int. Cl.
*A01N 1/00* (2006.01)
*F23G 1/00* (2006.01)
*A61C 19/00* (2006.01)

(52) U.S. Cl. ..... 27/24.1; 27/21.1; 433/34; 433/36; 433/37; 433/90; 110/194

(58) Field of Classification Search ..... 27/24.1, 27/21.1, 22.2; 433/34, 36, 37, 90, 39; 110/194
See application file for complete search history.

(56) References Cited

U.S. PATENT DOCUMENTS

| | | | | | |
|---|---|---|---|---|---|
| 803,474 | A | * | 10/1905 | Dennis | 433/80 |
| 1,371,029 | A | * | 3/1921 | Jennings | 604/77 |
| 2,251,749 | A | * | 8/1941 | Mandus | 433/36 |
| 2,440,187 | A | * | 4/1948 | Silverberg | 501/128 |
| 3,527,218 | A | * | 9/1970 | Westine | 433/80 |
| 3,722,097 | A | * | 3/1973 | Colman et al. | 433/36 |
| 4,227,910 | A | * | 10/1980 | Deeg | 65/269 |

(Continued)

FOREIGN PATENT DOCUMENTS

| | | | |
|---|---|---|---|
| EP | 0319639 | * | 4/1988 |
| WO | WO94/28820 | * | 12/1994 |

OTHER PUBLICATIONS

Rolfes, Bryan et al., Dental Presentation to Minnesota State Senator Marty at the Minnesota State Capitol, 17 pages. (Mar. 13, 2009).

(Continued)

*Primary Examiner* — Tatyana Zalukaeva
*Assistant Examiner* — Ginger T Chapman
(74) *Attorney, Agent, or Firm* — Dicke, Billig & Czaja, PLLC

(57) ABSTRACT

The invention described herein provides for a simple, economical system and method for reducing environmental release of dental amalgamous mercury from teeth caused by cremation of corpses. The invention controls and reduces the amount of mercury released using a pre-crematorial and non-disfiguring system and method. The system of the invention can include a dental containment and applicator delivery system to apply a curable thermal protectant composition onto the teeth. The composition coating significantly inhibits the extent of thermal destruction of the tooth per se including its amalgam filling content.

21 Claims, 8 Drawing Sheets

U.S. PATENT DOCUMENTS

| | | | | |
|---|---|---|---|---|
| 4,382,785 | A * | 5/1983 | Lococo | 433/36 |
| 4,781,174 | A * | 11/1988 | Gardner | 126/681 |
| 4,917,603 | A | 4/1990 | Haack | |
| 5,055,048 | A | 10/1991 | Vassiliadis et al. | |
| 5,275,564 | A | 1/1994 | Vassiliadis et al. | |
| 5,621,035 | A * | 4/1997 | Lyles et al. | 524/404 |
| 5,752,829 | A | 5/1998 | Goldsmith et al. | |
| 5,759,031 | A | 6/1998 | Goldsmith et al. | |
| 5,795,159 | A | 8/1998 | Ralls et al. | |
| 5,885,076 | A | 3/1999 | Ralls et al. | |
| 5,904,482 | A | 5/1999 | Long et al. | |
| 5,951,295 | A * | 9/1999 | Lyles et al. | 433/228.1 |
| 6,013,246 | A | 1/2000 | Langworth | |
| 6,047,711 | A * | 4/2000 | Wagner | 132/322 |
| 6,364,661 | B1 * | 4/2002 | Brattesani | 433/37 |
| 6,401,632 | B1 * | 6/2002 | Kaehr | 110/186 |
| 6,409,803 | B1 | 6/2002 | Tremel et al. | |
| 6,709,271 | B2 * | 3/2004 | Yin et al. | 433/228.1 |
| 6,790,038 | B2 | 9/2004 | Hubner et al. | |
| 7,021,932 | B2 | 4/2006 | Standish | |
| 7,303,395 | B2 | 12/2007 | Hornig et al. | |
| 7,306,460 | B2 | 12/2007 | Hubner et al. | |
| 7,572,416 | B2 * | 8/2009 | Alward et al. | 422/180 |
| 7,877,847 | B2 * | 2/2011 | Bills | 27/1 |
| 2003/0143511 | A1 * | 7/2003 | Trichas | 433/37 |
| 2003/0175660 | A1 * | 9/2003 | Yin et al. | 433/228.1 |
| 2004/0005525 | A1 * | 1/2004 | Brattesani | 433/37 |
| 2004/0074391 | A1 | 4/2004 | Durante et al. | |
| 2004/0219083 | A1 | 11/2004 | Schofield | |
| 2005/0100699 | A1 | 5/2005 | Durante et al. | |
| 2005/0148465 | A1 | 7/2005 | Durante et al. | |
| 2005/0152821 | A1 | 7/2005 | Durante et al. | |
| 2006/0048646 | A1 | 3/2006 | Olson et al. | |
| 2006/0116287 | A1 | 6/2006 | Durante et al. | |
| 2007/0104631 | A1 | 5/2007 | Durante et al. | |
| 2007/0166659 | A1 * | 7/2007 | Haase et al. | 433/37 |
| 2008/0299510 | A1 * | 12/2008 | Penchas et al. | 433/34 |
| 2010/0028831 | A1 * | 2/2010 | Pierson | 433/90 |
| 2010/0183996 | A1 * | 7/2010 | Tzou et al. | 433/3 |
| 2010/0221678 | A1 * | 9/2010 | Fischer | 433/90 |

OTHER PUBLICATIONS

Unifrax I LLC, "Unifrax Material Safety Data Sheet," FIBERFRAX® LDS Moldable® Ceramic Fiber, MSDS No. M0048, pp. 1-12 (Mar. 5, 2007). <http://www.unifrax.com/MSDSAPPR.nsf/byMSDS/M0048>.

* cited by examiner

| Tooth | Condition | Tooth pre burn | Tooth with refractory | Tooth post burn | Tooth only post burn | mass loss refractory | % mass loss refractory | mass loss tooth | % mass loss tooth | |
|---|---|---|---|---|---|---|---|---|---|---|
| all measurements are in grams | | | | | | | | | | |
| 1 | refractory | 4.8 | 11 | 8.5 | 3.1 | -0.8 | -15% | -1.7 | -35% | |
| 2 | none | 2.8 | | | 1.3 | | | -1.5 | -54% | |
| 3 | none | 1.8 | | | 0.7 | | | -1.1 | -61% | |
| 4 | refractory | 2.9 | 10.7 | 8.6 | 2 | -1.2 | -18% | -0.9 | -31% | |
| 5 | none | 1.9 | | | 0.8 | | | -1.1 | -58% | |
| control | refractory | 0 | 9.1 | 7.5 | | -1.6 | -18% | | | |
| | | | | | Average | -1.2 | -17% | -1.26 | -48% | |
| | | | | | | | | | -33% | average refractory |
| | | | | | | | | | -58% | average no refractory |

Fig. 8

SYSTEM AND METHOD FOR REDUCING ENVIRONMENTAL CREMATORIAL RELEASE OF MERCURY FROM MERCURY-CONTAINING DENTAL AMALGAM

CROSS-REFERENCE TO RELATED APPLICATIONS

This patent application claims priority under 35 U.S.C. §119(e) to U.S. Provisional Patent Application Ser. No. 61/117,277 entitled "SYSTEM AND METHOD FOR REDUCING ENVIRONMENTAL CREMATORIAL RELEASE OF MERCURY FROM MERCURY-CONTAINING DENTAL AMALGAM," having a filing date of Nov. 24, 2008, and U.S. Provisional Patent Application Ser. No. 61/174,593 entitled "APPLICATOR SYSTEM FOR REDUCING ENVIRONMENTAL CREMATORIAL RELEASE OF MERCURY FROM MERCURY-CONTAINING DENTAL AMALGAM," having a filing date of May 1, 2009, and both are incorporated herein by reference.

BACKGROUND

The use of mercury-silver amalgam materials as dental fillings is well known, and such compositions have been used in the field of dentistry for over 150 years. Mercury in amalgam form is relatively inert in the human mouth. During cremation, however, mercury content of amalgam becomes vaporized and released into the environment via the flue gases from the crematorium. As a result, the released mercury contaminates air, soil and water in the surrounding areas. Once deposited into the lakes and rivers, the mercury converts into methyl mercury, where it can enter the food chain and accumulate in the tissues of living organisms.

In general, there have been many attempts to control and regulate the levels of mercury in the environment. Laws have been enacted which regulate the amount of use and release of mercury in the industrial sector. More recently, attention has been drawn to the release of mercury associated with the funerary industry and the crematorial emissions. Currently, smokestack scrubbers are employed in an effort to control such emissions. Scrubbing systems are, however, expensive and require both short- and long-term maintenance.

Alternative techniques include the physical removal of the decedent's teeth prior to cremation. Numerous mechanical tooth extractors have been developed. Rigor mortis can render access to and removal of the decedent's teeth very difficult. There are also the social implications and discomfort associated with disfigurement and desecration-like techniques to the corpse by the survivors. Other techniques have been developed to control or handle mercury. These include complex techniques such as laser amalgam ablation, dental trap filtration and chemical deactivation of free mercury.

There exists a need in the field of cremation and funerary preparations for simple, cost-effective methods and techniques to reduce or control environmental release of mercury in dental amalgams in a non-disfiguring pre-crematorial manner.

SUMMARY

One aspect provides a simple, economical system and a method for reducing environmental release of dental amalgamous mercury from teeth caused by cremation of corpses. One aspect controls and reduces the amount of mercury released using a pre-crematorial and non-disfiguring system and method. Further, the system can be constructed so as to conveniently apply a protective coating onto the teeth of the decedent which significantly inhibits the extent of thermal destruction of the tooth per se including its amalgam filling content. Additional embodiments and advantages associated with the invention aside from those described above will become apparent from the following disclosure.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

The invention is further illustrated by the following drawings—none of which is intended to be construed as necessarily limiting the invention.

FIG. 8 is a table containing data from the experiment described in Example 1.

DETAILED DESCRIPTION

Figure 1:
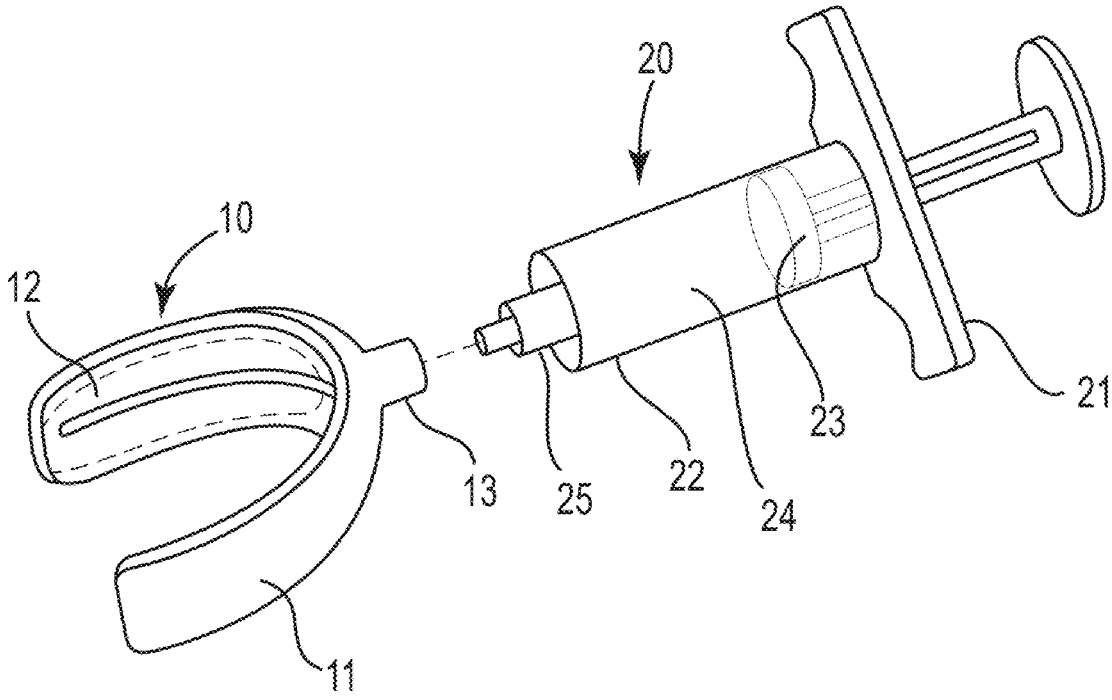
FIG. 1 is a view of an applicator separated from a dental containment of a system in accordance with one embodiment.

In the following Detailed Description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

As used herein, the term "comprising" means the elements recited, or their equivalent in structure or function, plus any other element(s) which are not recited. The terms "having" and "including" are also to be construed as open ended unless the context suggests otherwise. Terms such as "about," "generally," "substantially" and the like are to be construed as modifying a term or value such that it is not an absolute, but does not read on the prior art. Such terms will be defined by the circumstances and the terms that they modify are understood by those of skill in the art. This includes at the very least the degree of expected experimental error, technique error, and instrument error for a given technique used to measure a value.

As used herein, the term "crematorial," and variants thereof, are meant to refer to conditions associated with funerary or dispository elevated thermal or temperature treatments of deceased mammals including humans.

As used herein, the term "curable" is meant to refer to the change in physical state from a flowable fluid stage into a solid stage. The term is not meant to be limited to specific chemical (e.g., chemical interaction) or physical (thermally induced transition) techniques that can effectuate said change in state.

Embodiments described herein provide a system and method in the form of a dental pre-cremation treatment comprising application of a curable thermal protectant composition to one or more teeth containing mercury-containing amalgam. One aspect reduces the thermal damage to a mercury-containing amalgam in a crematorial treatment likewise reduces the amount of mercurial emissions in the exhaust or gases by retaining much of the elemental solid-state mercury within the tooth (teeth).

One embodiment provides a dental pre-cremation treatment comprising application of a curable thermal protectant composition to one or more teeth containing mercury-containing amalgam.

One embodiment also provides a system for reducing crematorial release of mercury from mercury-containing dental amalgam including a curable thermal protectant composition and an applicator. In one embodiment, the system further includes a dental containment.

One embodiment further provides a system for reducing thermal damage to dental amalgam during cremation including a curable thermal protectant composition, an applicator, and a dental containment, wherein the applicator and dental containment are constructed for mechanical coupling so as to permit fluid transport from said applicator through the dental containment. In one embodiment, the mechanical coupling structure is in the form of a Luer Lok, and the dental containment includes a fluid distribution structure.

Additionally, one embodiment provides for a method of reducing thermal damage to dental amalgam during cremation including applying a curable thermal protectant composition to one or more teeth containing mercury-containing amalgam in a body in advance of cremation of said body.

Furthermore, one embodiment provides a method for reducing crematorial release of mercury from mercury-containing dental amalgam including applying a curable thermal protectant composition to one or more amalgam-containing teeth of a body in advance of cremation of said body.

One embodiment provides an applicator system for delivering a curable thermal protectant composition to one or more teeth containing mercury-containing amalgam. In particular, one embodiment provides an applicator system for delivering a curable thermal protectant composition into the oral cavity (i.e., mouth) of a body, the system including an applicator including an elongated chamber and having a proximal portion and a distal portion, the distal portion further comprising an open end; a cap structured to removably attach onto the distal portion of the chamber; a delivery extension having a proximal portion and a distal portion, the extension distal portion having a bifurcated region having a pair of branches, each branch having an open distal end, and the proximal portion comprising an attachment element structured to removably attach to the distal portion of said chamber. Both said cap and said attachment element comprise respective coupling structures that cooperate with a corresponding coupling structure positioned at the distal portion of the chamber.

In an alternative embodiment, the delivery extension can be constructed to have a proximal portion and a distal portion, the distal portion having separate and distinct first and second branches, each branch having an open distal end.

The system can further include a powdered component of said curable thermal protectant composition contained with the chamber. In one embodiment, the applicator component comprises an elongated chamber in the form of a syringe assembly having a chamber in combination with a longitudinally-sliding plunger.

Curable Thermal Protectant Composition

One embodiment includes a curable thermal protectant composition. In one embodiment, amalgam-containing teeth are coated with a curable thermal protectant composition, which cures in situ in the mouth of the body. The curable thermal protectant can be applied to directly or indirectly to the teeth using the system described herein.

Suitable curable thermal protectant compositions that can be used can include those materials that have an initial flowable fluid stage followed by a hardened solid stage possessing thermal resistance properties that can reduce or inhibit the elevated temperatures associated with cremation. Curable thermal protectant compositions for use with the system can include, but are not limited to, ceramic or polymeric materials. Some thermal protectant compositions can comprise one or more high temperature refractory material component(s). The term "high temperature" in the context of a refractory material is meant to refer to a material capable of withstanding or providing a protective effect in elevated temperature environments as would be associated with the cremation process.

Refractory materials that can be included in such composition can include, but are not limited to, oxides of alimium (alumina), silicon (silica), magnesium (magnesia), calcium (lime), and calcium sulfate. Fireclays can be employed as well. In refractory material-containing compositions, a polymeric ingredient can function as a sacrificial binding component for the high-temperature refractory materials.

Curable materials generally have three stages: fluid stage, gel stage, and a final solid cured stage. In one embodiment, an important aspect of the composition is that in its final form it provides a high-temperature thermal barrier between the crematorial conditions and the encapsulated teeth.

The curing step can be performed in advance of cremation or during cremation. In advance of cremation, the curing stage can be effected by chemical reaction between the ingredients of the composition in ambient conditions, or effected by another technique, e.g., ultraviolet light or applied heat. Alternatively, the curable thermal protectant composition can be cured utilizing the heat at the beginning stages of the cremation process prior to the maximum applied heat. Thus, the composition cures in situ before the teeth are exposed to the more damaging levels of heat.

One composition that can be used can comprise a ceramic fiber-containing composition. An example of a ceramic fiber-containing composition is FIBERFRAX® LDS Moldable (available from Unifrax, L.L.C., Niagara Falls, N.Y.). The ingredients of the composition are set forth as follows:

TABLE 1

| FIBERFRAX ® Curable Thermal Protectant Composition | |
|---|---|
| Ingredient | Amount (% by weight) |
| Water | 40-45 |
| Silica (amorphous) | 25-30 |
| Fibers, aluminosilicate, refractories | 20-25 |
| Ethylene glycol | 3-5 |
| Polyethylene oxide | 1-2 |

Note:
As the amounts are expressed in variable ranges, the actual percentage amounts in a particular composition will total 100 percent.

The curable protectant composition can be presented in a variety of forms. In one embodiment, the curable composition can be presented at the onset in flowable fluid form in a container. The flowable fluid can be dispensed from the container directly or into an applicator. Alternatively, the container itself can be in the form of a pre-filled cartridge. Depending upon the particular composition of the thermal protectant, the container can be a double- or multi-barreled chamber design to combine physically separated ingredients to initiate the admixture and curing stages.

The curable protectant composition can also be presented as a dry powder to be combined with a second activating ingredient to be mixed to form the initial fluid to be applied. For initiating the curing stage in the composition by chemical reaction, the term "activating ingredient" is meant to refer to a broad group of chemical ingredients that can initiate the curing reaction when combined with another ingredient, such as a catalyst, cross-linking agent, and the like.

Secondary ingredients can be combined with the thermal protectant composition and refractory materials as well. Suitable secondary ingredients can include, but are not limited to, mercury capturing or binding agents, such as those used to clean up Hg spillage for hazardous material cleansing and removal. Mercury capture or binding agents can be especially useful in one embodiment in that they can be used to capture and prevent release of mercury that does manage to become released during cremation. Examples of mercury capture ingredients can comprise sulfur and sulfer compounds, zinc, and EDTA.

Applicator

Figure 5:
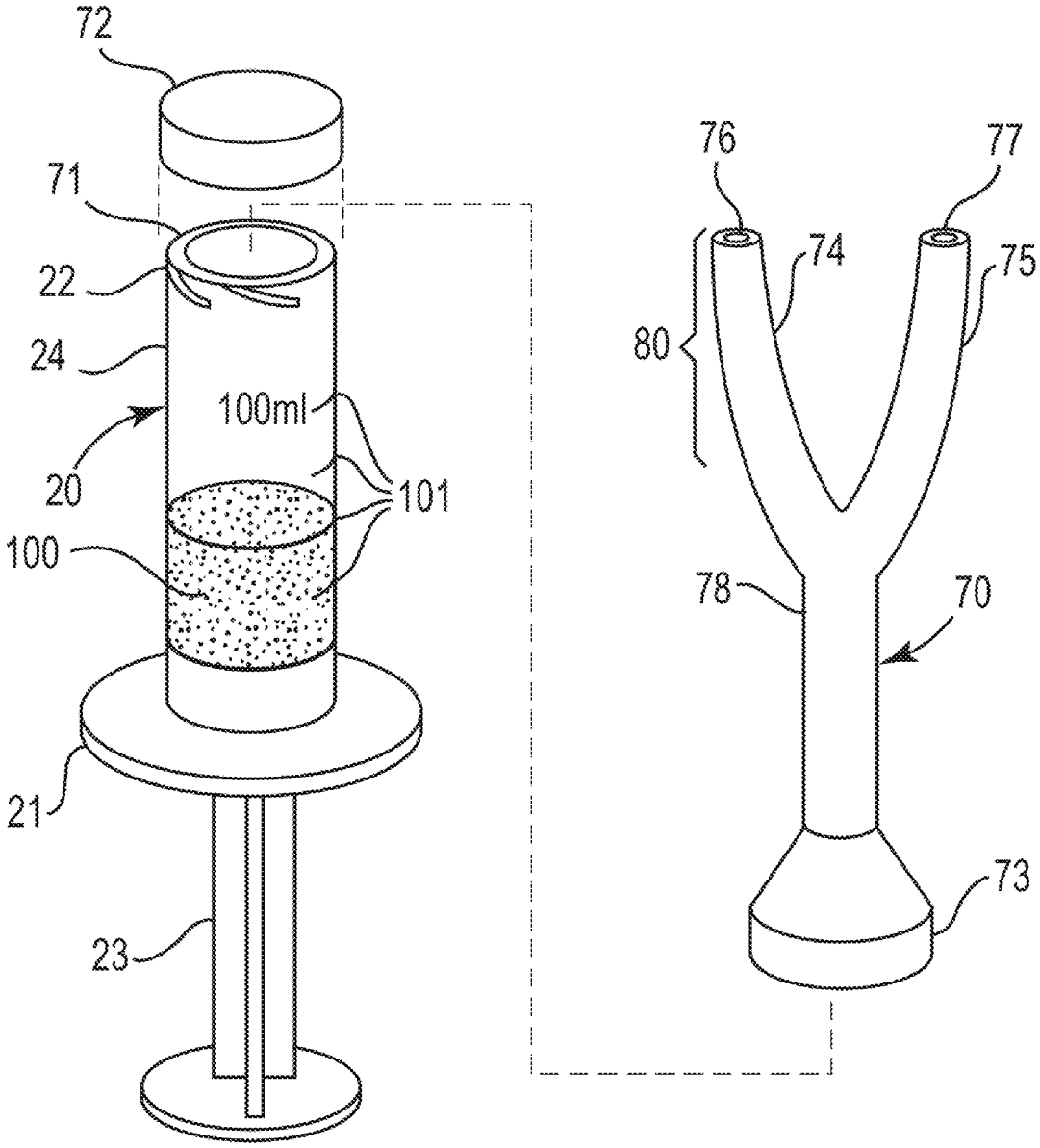
FIG. 5 illustrates an applicator system with an extension component in accordance with one embodiment.

The system can further comprise an applicator. A variety of applicators can be used provided they can controllably contain and dispense a flowable fluid-stage composition onto the teeth of the body, onto a dental containment or cooperate with a dental containment having a fluid distribution structure. Suitable applicator structures that can be used include, but are not limited to, syringe structures (i.e., plunger and chamber assemblies), pliable tubes, "caulking" gun and cartridge assemblies, and the like. In a preferred embodiment, the applicator mechanically cooperates with a dental containment to effectively distribute the fluid stage curable thermal protectant composition onto the teeth of the body being treated according to one embodiment. In FIG. 1, one embodiment of an applicator 20 is shown in the form of a syringe-like assembly. Another embodiment is illustrated in FIG. 5, as is discussed in more detail below.

Dental Containment

In order to coat or apply the curable thermal composition to the teeth in the mouth of the deceased, a dental containment can be employed to thoroughly distribute the fluid-stage composition onto the teeth. In one embodiment, the composition can be deposited onto the interior of the dental containment and then the fluid-filled dental containment can be inserted into mouth surrounding the teeth to deposit the composition onto the teeth, and then withdrawn.

In one embodiment, however, a more controlled application of the curable thermal protectant composition is performed using a dental containment having a fluid distribution structure. Referring now to FIG. 1, there is shown a system including a dental containment 10 in combination with an applicator 20 in the form of a manually actuated syringe having a proximal portion 21 and distal portion 22 (relative to the user's hand location) having a longitudinally-sliding plunger 23 and chamber 24 assembly. The distal portion 22 of the applicator can include a first coupling structure 25 constructed to coordinate with a second coupling structure 13 located on the dental containment 10 to collectively mechanically couple to form a contiguous fluid delivery conduit through which the curable thermal protectant composition (not shown) can be delivered. A number of mechanical coupling structures can be used as part of this system, including a Luer Lok arrangement a shown in FIG. 1. In an alternative or further embodiment, and in contrast to a dental containment and applicator that can be coupled, is a pre-combined applicator-dental containment device of unitary construction.

Figure 2:
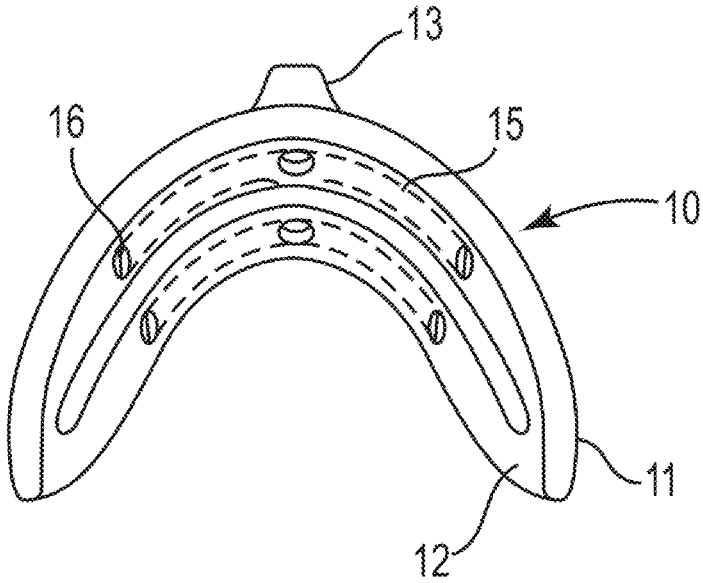
FIG. 2 is an angled side view of the interior surface of a dental containment containing a fluid distribution structure in accordance with one embodiment.

Referring now to FIGS. 1 and 2, the dental containment 10 can have an overall arcuate shape in accordance with the natural dental geometry of the human mouth. The dental containment 10 can have an exterior side 11 and an interior side 12 having a surface oriented so as to be adjacent to the body's teeth when positioned within the mouth. The dental containment can further comprise a second mechanical coupling structure 13 having a fluid injection port 14 (shown in FIGS. 3 and 4). The second coupling structure 13 can be constructed to couple with a first coupling structure 25 on the distal portion of an applicator 20 (e.g., distal portion 22 of a syringe). A variety of mechanical coupling arrangements can be employed, provided when coupled the structure(s) can collectively form a fluid delivery conduit and controllably deliver a flowable fluid from the applicator 20 into the dental containment 10.

Figure 3:
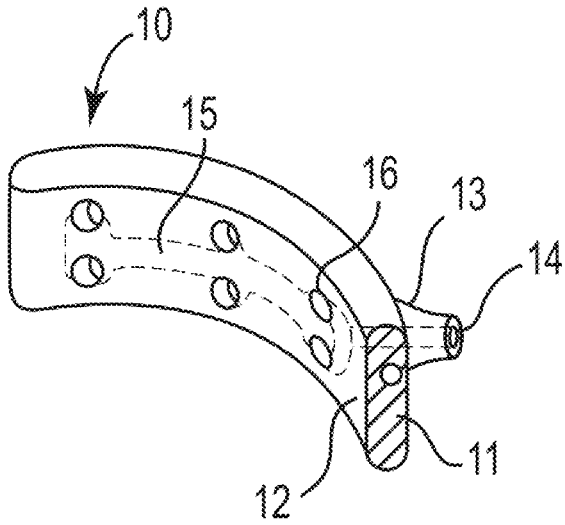
FIG. 3 is a transparent cut-away side view of a fragment of one end of a dental containment containing a fluid distribution structure in the form of an injection port, lumen and plurality of exit ports in accordance with one embodiment.

The fluid distribution structure associated with the dental containment 10 can take a variety of forms. Referring now to FIGS. 2 and 3, one embodiment of a fluid distribution structure is shown in the form of an injection port 14, internal lumen 15 and exit port 16 system. Fluid (not shown) received into the injection port 14 from the exterior side 11 of the dental containment 10 can travel through the lumen 15 within the containment and become distributed onto the teeth (not shown) through one or more exit ports 16.

Figure 4:
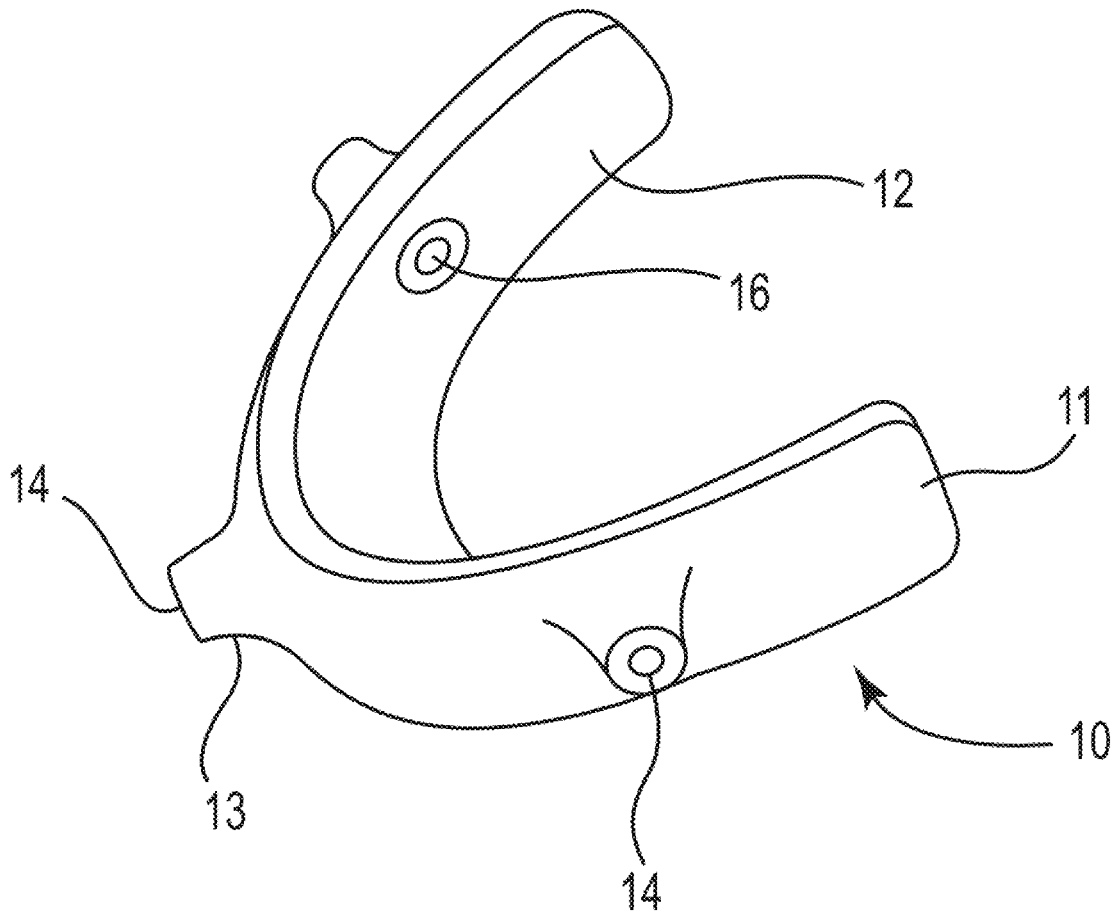
FIG. 4 is an angled top view of a dental containment showing a plurality of injection ports in accordance with one embodiment.

The dental containment design of the fluid distribution structure can vary widely and can be customized for various circumstances. The fluid distribution structure can vary in the number and location of injection ports 14, simplicity, branching, and complexity of the lumen 15, and number and location and exit port(s) 16. For example, a plurality of second coupling structures 13 each having injection ports 14 can be used as depicted in FIG. 4. Alternatively, a single injection port 14 can be used to receive the fluid and a complex lumen 15 and plural exit ports 16 can be used as shown in FIGS. 2 and 3. Also, a plurality of discrete injection ports 14 and exit ports 16 can be used as shown in FIG. 4. This particular design affords the advantage of more selective/precise, and/or more thorough, delivery of the curable thermal protectant to the teeth.

The dental containment 10 has been illustrated as containing an injection port-lumen-exit port design. However, in an alternative embodiment, the lumen and exit port arrangement can instead be replaced with an open channel, groove or trough structure. This is less preferred, however, because of the compromise to distribution control that might occur.

As the thermal protectant composition is applied to teeth embedded in the gum, supplemental treatment may be used as part of one embodiment. For instance, coating the exposed surface of amalgam-containing teeth can still leave the roots and tooth regions below the gum line vulnerable to thermal damage adjacent to the mercury-containing part of the teeth. In these situations, percutaneous injection of the thermal protectant composition through the gums to the root region of one or more of the teeth can be employed as well.

The dental containment 10 can be constructed from a variety of pliable, semi-rigid or rigid polymeric materials having a variety of physical properties. Suitable containment materials include, but are not limited to, elastomeric polymers such as silicone rubber, or plastics such as polyurethanes, PET, PVC, BT, polyethylene, epoxies, polycarbonate, acrylic, polyamide (nylon), polyimides, polystyrene, PEEK, and the like. The containment can be made using conventional molding equipment and techniques readily available to those in the medical device and/or dental fields.

The dental containment can be made using conformable elastomeric materials for "one-size-fits-all" dimensions. Alternatively, the various sizes of dental containments can be presented to provide more specific individualized containment fittings. In another embodiment, partial dental containments can be made so as to deliver lesser quantities of curable thermal protectant composition to more defined subsets of teeth.

In a further embodiment, the dental containment can be composed of metal or metallic alloy that can be left in place throughout cremation. In an alternative embodiment, the dental containment itself can be composed of a composition containing a refractory material and left in place through the cremation process.

FIG. 5 illustrates another embodiment of an applicator system 10 including an applicator 20 and a delivery extension 70. In order to coat or apply the curable thermal composition to the teeth in the mouth of the deceased, the applicator system 10 includes a delivery extension 70 to thoroughly distribute the fluid-stage composition onto the teeth.

In one embodiment, the applicator 20 is in the form of a manually actuated syringe having a proximal portion 21 and distal portion 22 (relative to the user's hand location) having a longitudinally-sliding plunger 23 and chamber 24 assembly. The distal portion 22 can further comprise an open end 71 and a cap 72 structured to removably attach onto the distal portion 22 of the chamber 24.

In one embodiment, the applicator system includes a delivery extension 70 having a proximal portion 73 and a distal portion having a bifurcated medial region 78 having a pair of branches (74 and 75), each branch having an open distal end 76 and 77, respectively. The delivery extension proximal portion 73 can comprise an attachment element (not shown) structured to removably attach to said distal portion 22 of the chamber 24. Both the cap 72 and the delivery extension attachment element can comprise respective coupling structures (not shown) that cooperate with a corresponding coupling structure positioned at the distal portion 71 of the chamber 24.

Figure 6:
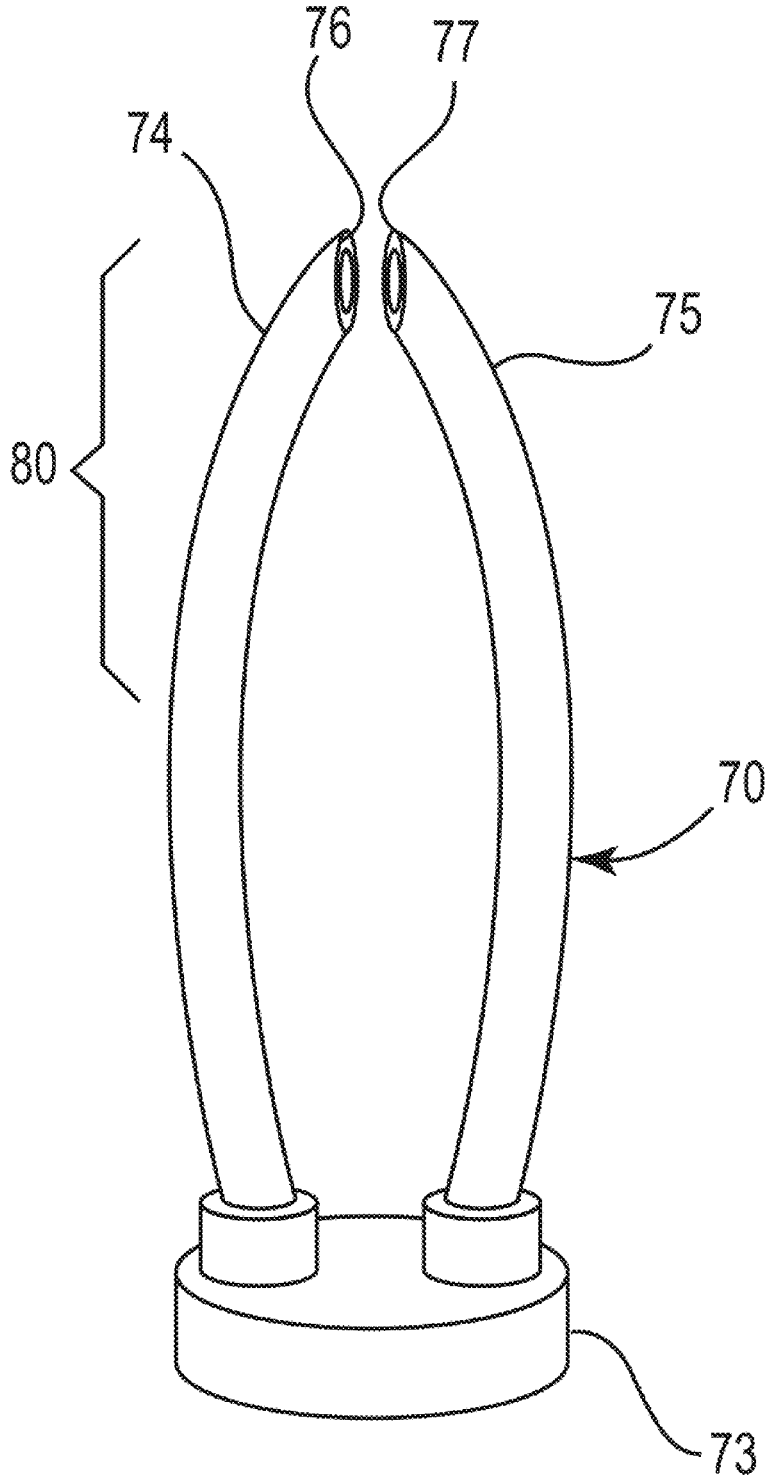
FIG. 6 illustrates a delivery extension component in accordance with one embodiment.

An alternative embodiment of the delivery extension 70 component is illustrated in FIG. 6. In this embodiment, the delivery extension 70 has a proximal portion 73 and a distal portion 80 and the distal portion 80 can be structured to have separate and distinct first and second branches (74 and 75), each branch having an open distal end 76 and 77, respectively. As with the other embodiment in FIG. 5, the delivery extension proximal portion 73 of FIG. 6 can comprise an attachment element (not shown) structured to removably attach to said distal portion 22 of the chamber 24. Both the cap 72 and the delivery extension attachment element can comprise respective coupling structures (not shown) that cooperate with a corresponding coupling structure positioned at the distal portion 71 of the chamber 24.

The cooperating removable attachment structures can take a variety of forms provided that when assembled, a fluid-tight conduit is formed to permit the flow of the thermal protectant composition in mixed state. Furthermore, the dimensions of the delivery attachment 70 and its interior dimensions can be constructed so as to account for the viscosity and desired flow rate associated with the thermal protectant composition during delivery.

The applicator 20 and elongated chamber 24 can be constructed in the form of a syringe assembly as illustrated in FIG. 5, wherein the chamber 24 is structured with a longitudinally-sliding plunger 23 residing within, and the proximal portion 21 of the chamber 24 can comprise a flange to facilitate handling and operation of the assembly.

For ease of use and simplified presentation of the system to the user, the chamber 24 of the applicator 20 can be prepared in advance to contain a powdered component 100 of a two-part curable thermal protectant composition contained with the chamber 24. This system including the powder component can be accompanied by the liquid ingredient (not shown) to be combined with the powder 100 and can include mixing instructions within a kit. Thus, the chamber 24, cap 72, or both, can include indicia or markings (illustrated as 101) that correspond to the preparation instructions to simplify and explain the preparation and delivery procedure to the user.

The delivery extension 70 can be composed of conventional suitable plastic and polymeric materials readily available to those skilled in the medical device manufacturing field. In the particular embodiment shown, the bifurcated medial region 78 and the branches 74 and 75 of the delivery extension 70 can be configured to have a spacing apart and curvature that accommodates pre-determined anatomical configuration of a human mouth and teeth. Alternatively, the bifurcated medial region 78 and branches 74 and 75 can be composed of a flexible semi-rigid material, such as a semi-rigid elastomeric polymer, for universal adjustment to the recipient mouth and teeth. Additionally, branches 74 and 75 of either configuration of FIG. 5 or FIG. 6 can be tapered to facilitate entry into the oral cavity.

In this embodiment, the applicator system as shown in FIG. 5 is presented to the user with the applicator 20 and delivery extension 70 as separate detached components, the applicator containing the powder component 100 contained and sealed within the chamber 24 by the cap 72. The user can remove the cap 72, and using the cap or indicia to indicate the fill line, add the liquid ingredient to the powder 100, re-attach the cap 72, and agitate the mixture within the chamber 24 by shaking and the like.

Alternatively, the powder component 100 can be presented in a separate packet or containment as part of the system, whereby the user would add the powder component 100 into an open-ended chamber 24 and then seal with the cap 72. If the mixture is adequately prepared, reattachment of the cap 72 may not be necessary, and the delivery extension 70 can be attached immediately.

In either arrangement, once mixed, the cap can be removed and the delivery extension 70 can be attached to the distal portion 22 of the chamber 24. The assembled system can then be applied to the recipient by placing the braches 74 and 75 of the deliver extension 70 into the recipient's mouth adjacent to the teeth and actuating the applicator 20 to deposit the mixed thermal protectant composition onto the teeth.

Figure 7:
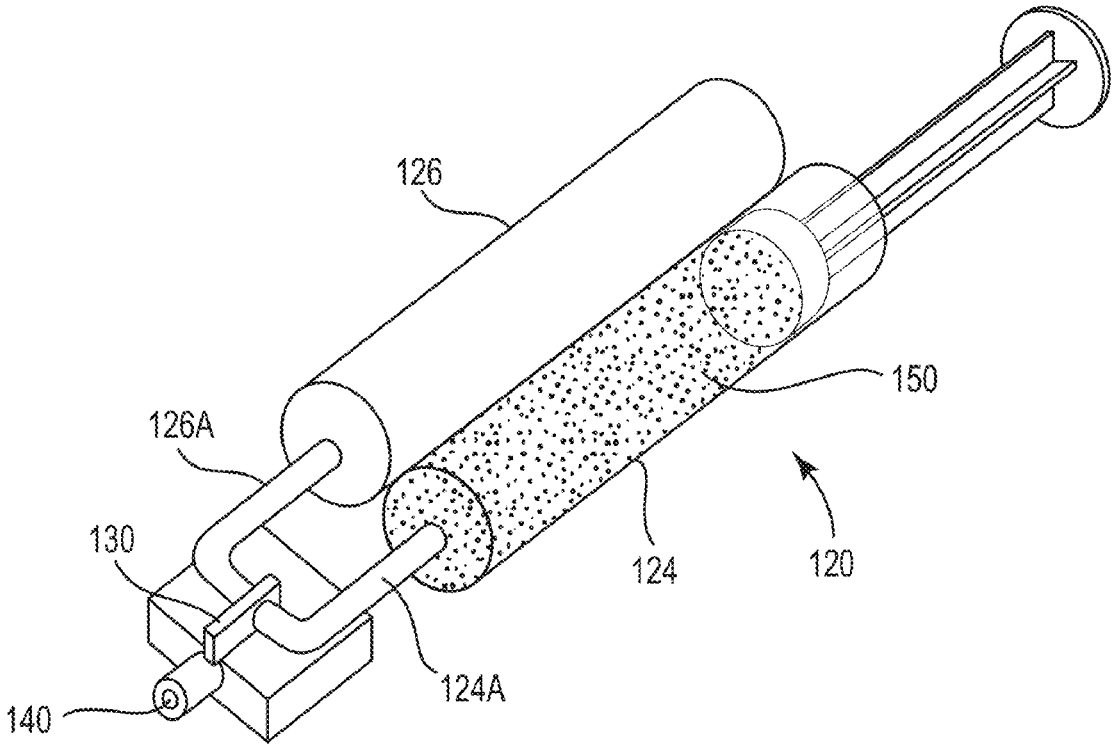
FIG. 7 illustrates an applicator of a system in accordance with one embodiment.

FIG. 7 illustrates another embodiment an applicator 120 in accordance with one embodiment. Applicator 120 includes a first chamber 124 and a second chamber 126. The powder component 100 can be contained in first chamber 124, which in one case is an evacuated syringe chamber. Second chamber 126 can then be loaded with the liquid component for mixing with the powder component 100. A valve 130 can be actuated to allow mixing of the powder 100 and the liquid from channels 124A and 126A before exiting at exit port 140.

Upon opening the connection between the two chambers, the liquid is drawn into the powder via the pressure differential and effectively mixing the components for eventual delivery. The fluid valve 130 can be of the three-way variety so that the single valve can be employed for both mixing of the two components and for injection of the mixed materials into the mouth.

In one embodiment, thermal damage is reduced to dental amalgam during cremation. By virtue of coating the teeth with a curable thermal protectant in advance of the cremation process, the extent of thermal damage to the teeth treated according to one embodiment is significantly inhibited or reduced. As a result of this reduced damage to the teeth and the amalgam content, the crematorial release of vaporized mercury is likewise reduced. Thus, one embodiment also contains a method of reducing mercurial emissions associated with cremation. This latter method focuses on the environmental benefit associated with the embodiment.

EXAMPLE 1

Comparative Experiment

Five human teeth containing amalgam fillings and material were removed from a plaster casting into which the roots of the teeth have been set. The teeth samples were labeled using numbers 1 through 5, photographed and weighed on a triple beam balance.

Tooth 1 and tooth 4 were selected as representative teeth, as tooth 1 was large in size and tooth 4 was smaller. Teeth 1 and 4 were set root-first into 2×2×1 inch foam block. Then, the fluid-state thermal protectant composition was dispensed onto each of teeth 1 and 4 using a caulking gun-type applicator onto the crown until coated with the composition. Thermal protectant composition in the absence of a tooth was prepared as the control. The deposited thermal protectant composition was then gently shaped over the teeth using a small spatula to ensure complete and thorough coverage of the tooth exterior. The coated teeth were set aside and allowed to air dry for a period of approximately 2 days, and then weighed. Sample teeth 2, 3 and 5 were untreated.

Each tooth sample was placed into a gas forge in order from back to front starting with tooth 1, etc. alongside a small mild steel 0.25" square rod for temperature gauging. The forge was ignited and adjusted to a neutral flame. The forge was run at full fuel flow for a period of 35 minutes following the adjustment of the flame. Based on the appearance and color of the steel brand heated in the fire, the temperature ranged from an estimated 2300 degrees to about 2400 degrees Fahrenheit, (about 1260 to about 1316 degrees Celsius). The teeth in this experiment were exposed to the heat conditions in the absence of surrounding tissue that would normally be present in intact whole-body corporeal cremation. Although normal whole-body cremation duration is performed for a period of about 2 hours, it is believed that a direct exposure of teeth to heat for a period of 35 minutes would somewhat resemble the effect to the thermal exposure protected by tissue during whole-body cremation for 2 hours.

The forge was turned off and the specimens were allowed to cool within the forge for an additional period from about 45 minutes to about 1 hour. Following the cooling step, the samples were carefully removed to ensure complete collection of all of the dental pieces including the unprotected teeth samples. Each of the tooth samples were placed into an aluminum foil packet.

The samples, including the intact samples coated with the thermal protectant composition, were weighed on a balance. The coating was broken open on the treated teeth samples and the teeth were separated from the coating and weighed again. In some occurrences, some residual coating material remained bonded onto the teeth fragments following the separation. These previously-coated teeth samples were also placed into aluminum foil packets.

The data of this experiment is set forth in FIG. 8. One of the teeth samples treated according to the embodiment (tooth 1) exhibited a visibly reduced extent of thermal damage from the heat. This is in contrast to teeth samples 2 and 5. Thus, the mercury-containing amalgam contained within the treated teeth likewise experienced reduced thermal damage thereby reducing the extent of vaporized mercury therefrom.

It may also be noted that small pieces of tooth/amalgam adhered readily to the refractory on tooth 1 (1-2 mm sized pieces). In tooth 4, pieces adhered readily to refracted material.

EXAMPLE 2

Crematorial Treatment

The following is an example illustrating the use of one embodiment as part of the cremation process. At the onset, a corpse to be cremated arrives at the mortuary and the mortician prepares the corpse for viewing. After the viewing and before cremation, the corpse can be prepared using a method in accordance with one embodiment.

The mouth and teeth are exposed to the user applying the composition. The curable thermal protectant composition can be applied directly to individual teeth, or applied to groups of some of the teeth. Alternatively, the curable thermal protectant can be applied to coat all teeth in the mouth of the body. In the case of a full-size dental containment having a fluid distribution structure (e.g., with an injection port, lumen, and exit port), the dental containment is placed inside the mouth of the corpse adjacent to the teeth.

The applicator is filled with a prepared curable thermal protectant composition. Alternatively, an applicator can be present in pre-filled condition to the user. The applicator is then coupled to the injection port of the dental containment and actuated to deliver the flowable curable thermal protectant composition through the dental containment and distribute the fluid onto the exterior of the teeth.

Once the composition has been thoroughly deposited to the extent desired to cover the amalgam-containing teeth, both the dental containment and applicator can be withdrawn. In the case of ambient-cured or pre-cremation curing composition formulations, the composition is permitted to cure for the time period necessary prior to placing the body into the crematorial chamber for processing. In the case of heat curable composition formulations, the body can be immediately placed into the crematorial chamber for processing.

Figure 9A:
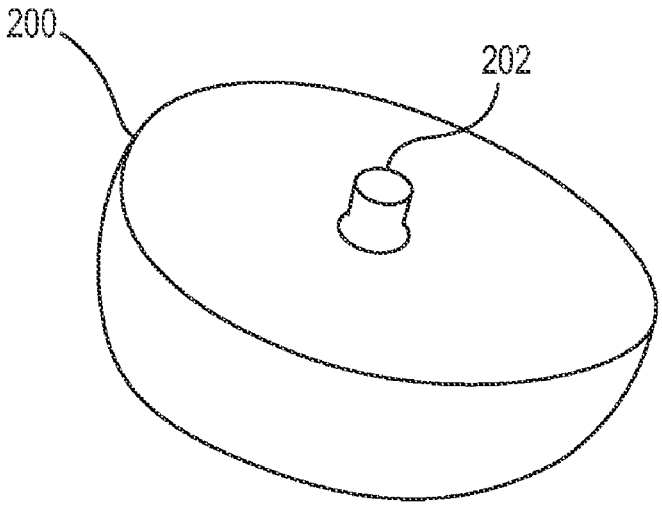
FIGS. 9A and 9B illustrate an external shield component in accordance with one embodiment.
Figure 9B:
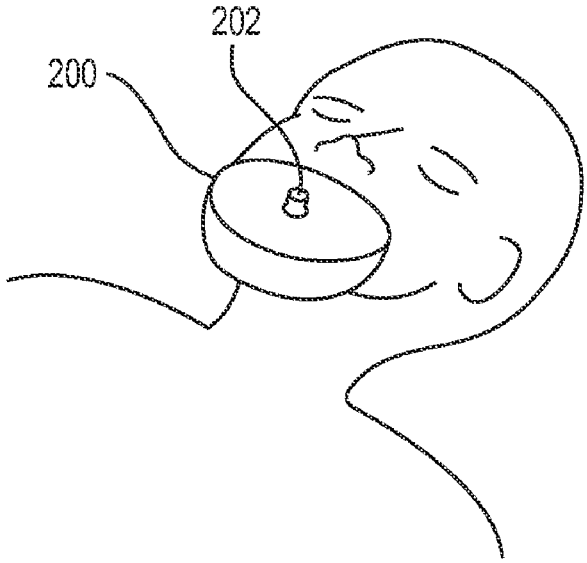

Alternatively, in one embodiment, external heat shielding is also applied over the jaw area of the body after the heat curable composition is applied over the teeth. FIGS. 9A and 9B illustrate external shield component 200 in accordance with one embodiment. In one embodiment, this additional external heat shielding is a plate that is placed over the jaw area of the body. In one embodiment the shielding can be somewhat bowl-shaped for easy placement over the jaw area.

In one embodiment, heat shield 200 is configured with a port 202 through which refractory material can be introduced into the mouth once the shield 200 is in place over the jaw of the body. In other embodiments the refractory material is already introduced before placing heat shield 200. In one embodiment, port 202 of shield 200 is coupled to an applicator or delivery extension as described above for facilitating delivery of refractory material into the mouth.

In one embodiment, the shielding plate or bowl is a high temperature refractory material capable of withstanding elevated temperature. Such refractory materials can include, but are not limited to, oxides of alimium (alumina), silicon (silica), magnesium (magnesia), calcium (lime), and calcium sulfate. Fireclays can be employed as well. In one embodiment, the shielding plate could also be made of metal, such as steel or stainless steel, or steel with refractory materials. Using a heat shielding plate can temporarily delay heat penetration to the teeth once the cremation process begins. This can increase the efficacy of the thermal protectant composition that is within the mouth cavity directly over the teeth.

The corpse is then cremated. Following the completion of the cremation step, the remaining bone and refractory material (that is, pre-treated teeth according to the embodiments and/or external shielding plates when used) can be retrieved for disposal. The refractory material containing the mercury can be contained and stored in accordance with hazardous waste procedures and equipment, and delivered to a reclamation or disposal facility.

Although the invention and its benefits have primarily been discussed within the context of mercury release from mercury-containing amalgam fillings and dental work, it will be understood that overall the invention is not specific to the inhibition of crematorial mercury release. Rather, the thermal protectant composition can be applied to any externally accessible material or alloy to reduce or control undesired release of elements or gases generated by elevated thermal or crematorial treatments of the material or alloy. Just as the thermal protectant composition inhibits thermal damage to amalgam, it will be expected that similar thermal protectant effect could be possible irrespective of the subject material.

The system and methods of the embodiments can be used in the pre-cremation preparation of a body as a means to reduce undesirable environmental release of mercury present in mercury-containing dental amalgam materials.

It is to be understood that the features of the various exemplary embodiments described herein may be combined with each other, unless specifically noted otherwise.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A method of dental pre-cremation treatment of a mouth of a body comprising:

providing an applicator system and curable thermal protectant composition;

expelling the curable thermal protectant composition from a chamber of the applicator system;

applying the curable thermal protectant composition to one or more teeth containing mercury-containing amalgam in the mouth of the body prior to cremation of the body using the applicator system; and encapsulating the mercury-containing amalgam of the one or more teeth containing mercury-containing amalgam with the curable thermal protectant composition.

2. The method of dental pre-cremation treatment of claim 1, wherein the curable thermal protectant composition comprises, as a percent by weight 40-45 percent water, 25-30 percent amorphous silica, 20-25 percent fibers, aluminosilicate, refractories, 3-5 percent ethylene glycol, and 1-2 percent polyethylene oxide.

3. The method according to claim 1, wherein said curable thermal protectant composition is cured prior to cremation.

4. The method according to claim 1, wherein said curable thermal protectant composition is cured during cremation.

5. The method of dental pre-cremation treatment of claim 1, wherein applying the curable thermal protectant composition includes coating at least a majority of a crown of the one or more teeth containing mercury-containing amalgam.

6. The method of dental pre-cremation treatment of claim 1, wherein applying the curable thermal protectant composition includes percutaneous injection of the curable thermal protectant composition through gums of the mouth to a root region of the one or more teeth.

7. A system for reducing crematorial release of mercury from mercury-containing dental amalgam comprising:

a curable thermal protectant composition;

an applicator comprising an elongated chamber and having a proximal portion and a distal portion, said distal portion further comprising an open end; and a dental containment attachable to the applicator, the dental containment having an arcuate shape including an exterior side and an interior side opposite the exterior side, wherein the dental containment is configured to be placed into a mouth of a body with the interior side having a surface configured to be placed adjacent to a front surface of teeth in the mouth, and wherein the dental containment comprises a fluid distribution structure including at least one injection port, an internal lumen, and at least one exit port on the interior side, the fluid distribution structure configured to distribute the curable thermal protectant composition in the mouth of the body.

8. The system according to claim 7, comprising a plurality of injection ports and a plurality of exit ports.

9. The system according to claim 7, wherein said applicator is one of a group consisting of a syringe structure, a caulking gun and cartridge system.

10. The system according to claim 7, wherein said curable thermal protectant composition comprises an in situ curable material.

11. The system according to claim 10, wherein said curable thermal protectant composition comprises a heat curable material.

12. A method for reducing crematorial release of mercury from mercury-containing dental amalgam comprising:

providing a curable thermal protectant composition;

applying a curable thermal protectant composition to one or more amalgam-containing teeth in a mouth of a corpse in advance of cremation of said corpse; and coating at least a crown of the one or more amalgam-containing teeth in a mouth of a corpse.

13. The method according to claim 12, wherein said curable thermal protectant composition is cured in the mouth of the corpse prior to cremation.

14. The method according to claim 13, wherein an external shield is placed external to a jaw of the corpse prior to cremation.

15. The method according to claim 12, wherein said curable thermal protectant composition is cured during cremation.

16. An applicator system for delivering a curable thermal protectant composition into an oral cavity of a body, said system comprising:

an applicator comprising an elongated chamber and having a proximal portion and a distal portion, said distal portion further comprising an open end;

a cap structured to removably attach onto said distal portion of said chamber; and a delivery extension having a proximal portion and a distal portion, said distal portion having a bifurcated region having a pair of branches, each branch terminating at an open distal end, and said proximal portion comprising an attachment element structured to removably attach to said distal portion of said chamber;

wherein both said cap and said attachment element comprise respective coupling structures that cooperate with a corresponding coupling structure positioned at said distal portion of said chamber.

17. The system according to claim 16, wherein said chamber of said applicator further comprises a powdered component of said curable thermal protectant composition contained with said chamber.

18. The system according to claim 16, wherein said applicator and elongated chamber comprise a syringe assembly having a chamber in combination with a longitudinally-sliding plunger.

19. An applicator system for delivering a curable thermal protectant composition into an oral cavity of a body, said system comprising:

an applicator comprising an elongated chamber and having a proximal portion and a distal portion, said distal portion further comprising an open end;

a cap structured to removably attach onto said distal portion of said chamber; and a delivery extension having a proximal portion and a distal portion, said distal portion having a separate and distinct first and second branches, each branch terminating in an open distal end, and said proximal portion comprising an attachment element structured to removably attach to said distal portion of said chamber;

wherein both said cap and said attachment element comprise respective coupling structures that cooperate with a corresponding coupling structure positioned at said distal portion of said chamber.

20. The system according to claim 19, wherein said chamber of said applicator further comprises a powdered component of said curable thermal protectant composition contained with said chamber.

21. The system according to claim 19, wherein said applicator and elongated chamber comprise a syringe assembly having a chamber in combination with a longitudinally-sliding plunger.

* * * * *